US005579943A

United States Patent [19]

Johnson

[11] Patent Number: 5,579,943

[45] Date of Patent: Dec. 3, 1996

[54] CONTAINER AND DISPENSING CLOSURE LID HAVING A TEAR-AWAY TAB

[75] Inventor: Walter L. Johnson, Northbrook, Ill.

[73] Assignee: Phoenix Closures, Inc., Naperville, Ill.

[21] Appl. No.: 449,432

[22] Filed: May 24, 1995

[51] Int. Cl.[6] ..... B65D 51/22

[52] U.S. Cl. ..... 220/258; 215/239; 215/255; 220/254; 220/266; 220/270; 220/359; 222/153.07; 229/237; 229/242

[58] Field of Search ..... 220/258, 265, 220/266, 269, 270, 359, 256, 254; 215/232, 750, 255, 295, 241; 229/123.9, 237, 242, 924–926; 222/153.01, 153.06, 153.07, 153.09

[56] References Cited

U.S. PATENT DOCUMENTS

| | | | |
|---|---|---|---|
| 1,824,862 | 9/1931 | Young | 229/242 X |
| 2,967,010 | 1/1961 | Cuffey et al. | 229/242 X |
| 3,255,949 | 6/1966 | Buttery | 229/242 X |
| 3,977,562 | 8/1976 | Wedzik | 220/359 X |
| 4,165,015 | 8/1979 | Hasegawa . | |
| 4,209,126 | 6/1980 | Elias . | |
| 4,212,395 | 7/1980 | Korte | 229/237 |
| 4,215,793 | 8/1980 | Packard | 229/123.2 X |
| 4,285,442 | 8/1981 | Wedzik . | |
| 4,460,103 | 7/1984 | Rama et al. . | |
| 4,708,257 | 11/1987 | DeLine | 220/258 X |
| 4,863,061 | 9/1989 | Moore . | |
| 4,889,239 | 12/1989 | Sandish et al. | 229/242 X |
| 4,890,758 | 1/1990 | Gailus . | |
| 5,236,120 | 8/1993 | Kleemola | 229/123.2 |

*Primary Examiner*—Allan N. Shoap
*Assistant Examiner*—Robin A. Hylton
*Attorney, Agent, or Firm*—Welsh & Katz, Ltd.

[57] ABSTRACT

A dispensing closure lid having a tear-away tab for use with a container. The tab itself is configured with an outwardly extending grasping member. The pull tab is defined by a distinct sequence of slits and perforations. The slits have a greater length than the perforations. The specific sequence of slits and perforations facilitates removal of the tab from the container mouth and provides for a clean separation of the tab from the land surface of the container and the remaining lid without tearing into the lid.

2 Claims, 2 Drawing Sheets

CONTAINER AND DISPENSING CLOSURE LID HAVING A TEAR-AWAY TAB

The present invention relates to tear-away tab lids and liners used to seal the mouth of containers until removed by the user, and more specifically, to a tear-away tab lid or liner having a unique sequence of slits and perforations that facilitates removal of the tear-away tab portion.

BACKGROUND OF THE INVENTION

Tear-away tab lids and liners, such as the one described herein, are commonly utilized as non-spill covers for containers housing liquid or granular products. Typically, such covers are useful on disposable coffee creamer packages, instant or microwavable foods or disposable beverage containers. Covers that utilize tear-away tabs are also commonly used on cups housing hot coffee, tea, chocolate, or soup to be drunk while the consumer is moving.

Containers using pull tear-away tab lids or liners have become prevalent in the marketplace and serve several useful functions. First, they serve to insure that no foreign matter enters the container, they maintain freshness and they prevent spillage. Second, they serve a safety function by preventing purposeful tampering with the product, because access to the interior of the container cannot be achieved without puncturing or tearing the lid.

However, with conventional tear-away tab lids, a common problem is that the tearing of the tear-away tab (by an upward and/or sideways tearing force by the consumer) can unintentionally tear and often lift the remaining body portion of the lid from the container. With conventional tear-away tab arrangements often times the severing of the tear-away tab from the remaining lid is difficult to start. Further, even if successfully started, as the tear-away tab is torn away from the remaining lid, the severing or tearing action is not clean and causes unwanted tearing further into the lid. Consumers may decide to bypass the tab and simply pull off the entire lid or may use a knife or other utensil to poke a hole through the lid. Such difficulties with conventional tear-away tab lids, may negatively impact the consumer's opinion of the product and counter-effect the usefulness of these types of lids and liners.

Therefore, there is a need for an inexpensive lid or liner with a tear-away tab having an improved tearing capability. The tear-away tab should facilitate severance of a tear-away tab without tearing the lid.

SUMMARY OF THE INVENTION

Accordingly, it is an object of the present invention to provide a tear-away tab lid or liner having an improved tearing capability such that the severance of the tear-away tab is easily commenced without damage to the lid or liner, especially in the area where the lid or liner is adhered to the container lip.

It is another object of the present invention to provide a tear-away tab lid or liner having an array of slits and perforations that enables the tear-away tab to be torn away from the remaining portion of the lid or liner without tearing into the lid or liner itself.

In accordance with the present invention, all of these objects, as well as others not herein specifically identified, are achieved generally by the present tear-away tab lid having a main body portion and a tear-away tab portion. The tear-away tab portion is defined by a specific arrangement of longer slits and shorter perforations which facilitate the removal of the tab while preventing the lid from being torn. More specifically, this particular array, in clockwise order, comprises a slit at the base of the tab, a plurality of smaller perforations, another slit at the axial extreme of the tab portion and then perforations again extending towards the other base of the tab. The perforations are substantially smaller cuts made through the lid than are the slits.

BRIEF DESCRIPTION OF THE DRAWINGS

Further objects of the invention, taken together with additional features contributing thereto and advantages occurring therefrom, will be apparent from the following description of the invention when read in conjunction with the accompanying drawings, wherein.

DETAILED DESCRIPTION OF THE INVENTION

Figure 1:
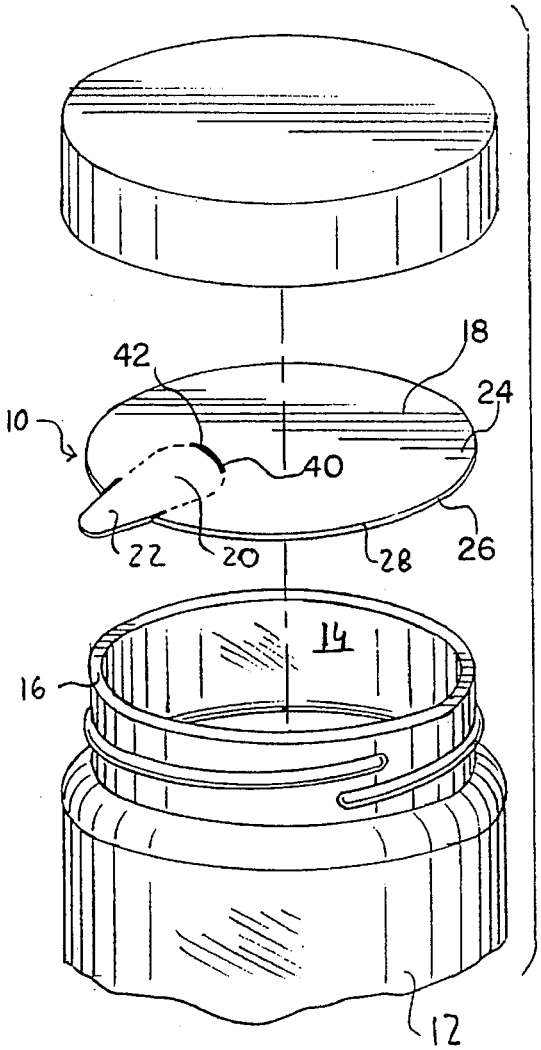
FIG. 1 is an exploded side view of the present tear-away tab lid shown together with a conventional closure cap and container.
Figure 2:
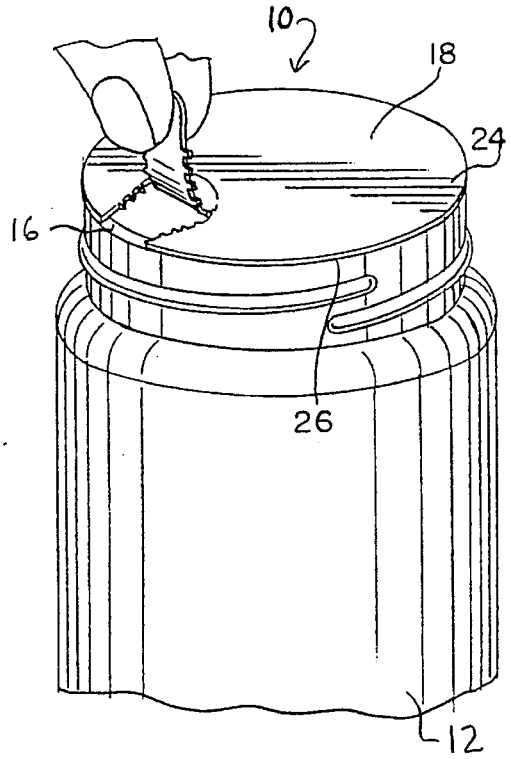
FIG. 2 is a plan view of the present tear-away tab lid adhered to a conventional container.
Figure 3:
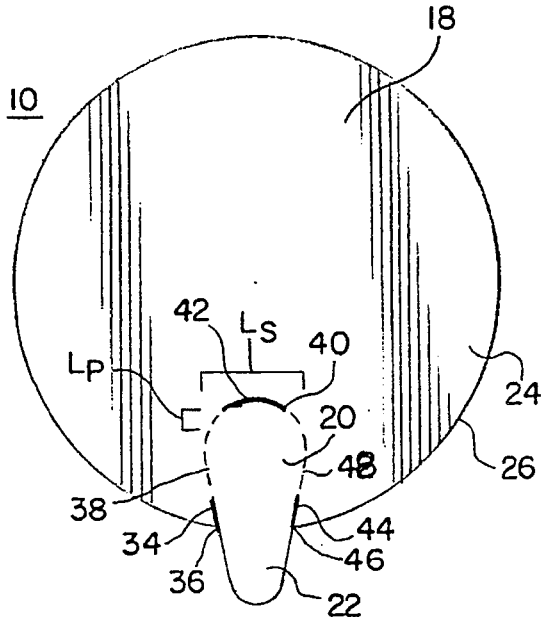
FIG. 3 is a plan view of the preferred embodiment of the present tear-away tab lid.

In the drawings, referring first to FIGS. 1–3, wherein a preferred embodiment of the invention is shown, reference number 10 designates generally the present tear-away tab lid. The tear-away tab lid 10 is designed for use with any type of container 12 used for storing and dispensing powder, liquid or other types of substances. Although a specific type of container is not required for use with the present tear-away tab lid 10, it is contemplated that the typical container 12 will include a mouth 14 having a substantially flat land surface 16.

More particularly, the tear-away tab lid 10 of the present invention includes a main body portion 18 and a tear-away tab portion 20. The tear-away tab portion 20 further includes an integral grasping member 22, which projects radially from the periphery of the lid 10. The lid 10 has an upper surface 24 and a lower surface 26. The lower surface 26 is adhered to the land surface 16, and since it provides the immediate cover to the product contained in the container 12, is preferably a layer of foil or other material that will not dissolve or deteriorate when contacting the product.

The body portion 18 and the tear-away tab portion 20 together form a substantially disk-shaped lid 10 that is dimensioned to span the mouth 14 of the container 12 and to be adhered to the land surface 16. Accordingly, the peripheral edge 28 of the lid 10 will typically align with the land surface 16, except for the grasping member 22. The grasping member 22 is configured to provide the user with a surface to grip in order to commence the removal of the tear-away tab portion 20 from the body portion 18 while adhered to container 12.

As set forth above, an object of the present invention is to facilitate the severance of the tear-away tab 20 while also preventing unintentional tearing of the body portion 18. To this end, the present lid 10 contemplates a unique arrangement of perforations and slits. The terms slits and perforations are intended only for purposes of identification and description and should not be interpreted as limiting the scope of the invention. For purposes of description, the slits are defined as having a Length $L_S$ which is greater than the Length $L_P$ of the perforations. Accordingly, as shown best in FIG. 3, the tab portion 20 is itself bound by and therefore, defined by these slits and perforations. More specifically, in clockwise order, the array or sequence begins with a first slit 34 at a base point 36. The first slit 34 is followed by a first set of perforations 38. The first set of perforations 38 are then followed by a second slit 40, which is formed along the axial extreme 48 of the tab portion 20 opposite the grasping member 22. Following the second slit 40 there is a second set of perforations 42. Preferably, the second set of perforations 42 are formed substantially opposite the first set of perforations 38. Finally, the array or sequence terminates with a third slit 44 formed at the other base 46 of the lid 10.

In operation, a consumer will grasp the grasping member 22 and provide a severing force by lifting the grasping member 22 upwards and towards the main body portion 18. The first and third slits 34 and 44 provide a guide for severance of the tear-away tab portion 20 from the lid 10 across the land surface 16 of the container 12 into the perforations 38 and 42. Because the lower surface 26 is usually glued to the land surface 16, the slits 34 and 44 facilitate removal of the tab portion 20 from over the land surface 16 and the body portion 18.

The slits 34 and 44 also guide the severing action into the perforations 38 and 42. As the consumer pulls upwards, the perforations 38 and 42 then allow for continued severance of the tab portion 20 into the remaining second slit 40. The advantage of using a second slit at the axial extreme point 48 between the body portion 18 and tab portion 20 is that it allows for a clean severance of the tab portion 20 from the body portion 18 without tearing further into the body portion 18 and thereby destroying the lid 10. The slits 34, 40 and 44 can be configured with a width greater than the width of the perforations 38 and 42 to facilitate the initial severing and further prevent tearing.

It is contemplated that the current lid 10 will be manufactured from materials typically used for lids and liners of this type, such as but not limited to: paper, foil, polyethylene and polypropylene. The lid 10, and particularly the slits and perforations, can be formed using any of the known, conventional methods of manufacturing.

Figure 4:
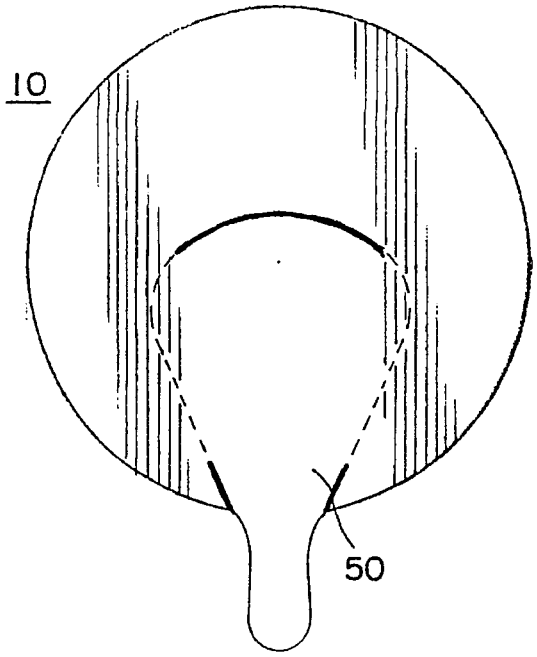
FIG. 4 is a plan view of an alternative embodiment of the tear-away tab.
Figure 5:
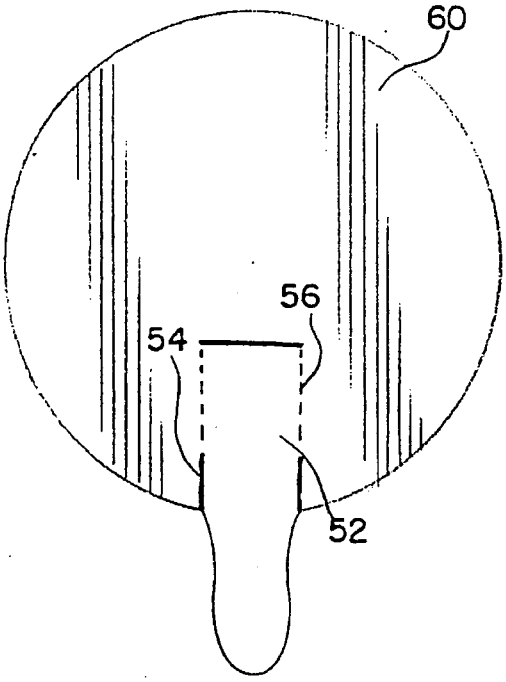
FIG. 5 is a plan view of another alternative embodiment of the present tear-away tab lid.
Figure 6:
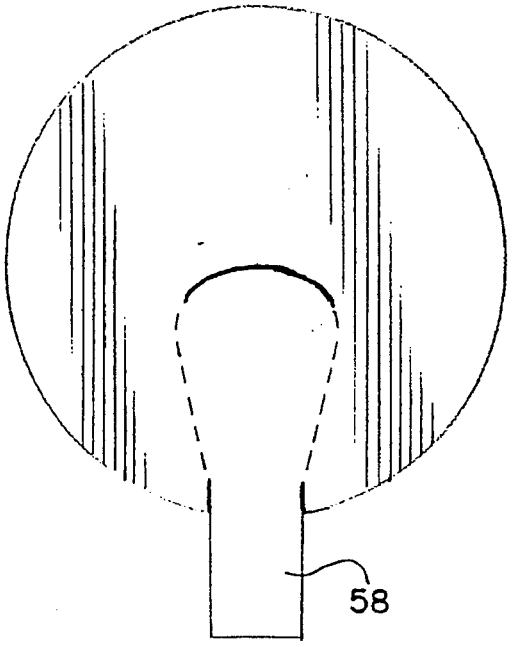
FIG. 6 is a plan view of another alternative embodiment of the present tear-away tab lid.

As shown in FIGS. 4–6 the features of lid 10 can be modified without departing from the scope of the present invention. The size and shape of the tab portion 20 can be modified to address the needs of a particular product. For example, in FIG. 4, the tab portion 50 may have a larger diameter in order to facilitate pouring or dispensing of certain products. In FIG. 5, the tab portion body portion 52 is rectangularly shaped. The slits 54 and perforations 56 may also be specially sequenced to facilitate commencement of the severing action while eliminating tearing into the body portion 60 as in FIG. 5. Likewise, as shown in FIG. 6, the size and shape of the grasping member 58 can be adapted to match specific needs, which may be dictated by the product or container, without departing from the scope of the present invention.

Thus, it is apparent that there has been provided, in accordance with the present invention, a tear-away tab lid 10 that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to include all such alternatives, modifications and variations as set forth within the spirit and broad scope of the appended claims.

What is claimed is:

1. A lid having a tear-away tab portion for use with a container having a mouth that includes a land surface, said lid comprising:

a main body portion having an upper and lower surface and a tab portion said tab portion detachable from said main body portion, said tab portion having a generally radially outwardly extending grasping member, said tab portion further having an innermost section diametrically opposed from said grasping member;

said main body portion being configured to fit over the mouth of the container, said lower surface fixable to the land surface of the mouth;

a sequence of slits and perforations formed through a flat portion of said main body portion, said sequence of slits and perforations facilitating the initial removal of said tab portion from said main body portion and preventing tearing into said body portion during removal of said tab portion, said slits being wider than said perforations; and said sequence consisting of, in clockwise order, a first slit adjacent said grasping member followed by a first plurality of perforations followed by a second slit at said innermost portion followed by a second plurality of perforations followed by a third slit adjacent said grasping member and opposite said first slit.

2. A lid having a tear-away tab portion in combination with a container having a mouth having a land surface, said lid comprising:

a main body portion having an upper and lower surface and a tab portion, said tab portion detachable from said main body portion, said tab portion having a generally radially outwardly extending grasping member, said tab portion further having an innermost section diametrically opposed from said grasping member;

said body portion being configured to fit over the mouth of the container, said lower surface fixable to the land surface of the mouth;

a sequence of slits and perforations formed through a flat portion of said main body portion, said sequence of slits and perforations facilitating the initial removal of said tab portion from said main body portion and preventing tearing into said body portion during removal of said tab portion;

said sequence consisting of, in clockwise order, a first slit adjacent said grasping member followed by a first plurality of perforations followed by a second slit at said innermost portion followed by a second plurality of perforations followed by a third slit adjacent said grasping member and opposite said first slit; and said first and said third slits formed so as to align with the land surface and thereby provide a guide for the removal of said tab portion across the land surface of the container to said first and said second plurality of perforations.

* * * * *